US005984609A

United States Patent [19]

Bartlett

[11] Patent Number: 5,984,609

[45] Date of Patent: Nov. 16, 1999

[54] LIFTING AND TIPPING MECHANISM FOR FRONT LOADING REFUSE TRUCK

[75] Inventor: William P. Bartlett, Dodge Center, Minn.

[73] Assignee: McNeilus Truck and Manufacturing, Inc., Dodge Center, Minn.

[21] Appl. No.: 09/027,889

[22] Filed: Feb. 23, 1998

[51] Int. Cl.[6] ..... B65F 3/04

[52] U.S. Cl. ..... 414/408; 414/420

[58] Field of Search ..... 414/406, 408, 414/420; 91/406, 409; 92/143

[56] References Cited

U.S. PATENT DOCUMENTS

| | | | |
|---|---|---|---|
| 3,085,703 | 4/1963 | Dempster et al. | 414/406 |
| 3,415,169 | 12/1968 | Naddell | 91/405 X |
| 3,661,285 | 5/1972 | Appleman | 414/408 |
| 3,677,141 | 7/1972 | Lagerqvist et al. | 91/407 X |
| 3,827,587 | 8/1974 | Liberman et al. . | |
| 3,988,979 | 11/1976 | Smith . | |
| 4,085,857 | 4/1978 | Smith . | |
| 4,085,858 | 4/1978 | Smith . | |
| 4,088,234 | 5/1978 | Smith . | |
| 4,091,944 | 5/1978 | Gollnick | 414/408 |
| 4,148,517 | 4/1979 | Smith . | |
| 4,230,359 | 10/1980 | Smith . | |
| 4,547,118 | 10/1985 | Pittenger . | |
| 4,552,500 | 11/1985 | Ghibaudo et al. | 414/408 |
| 4,597,710 | 7/1986 | Kovats | 414/409 |
| 4,647,267 | 3/1987 | Hund, Jr. | 414/408 |
| 4,915,570 | 4/1990 | Rath et al. . | |
| 5,266,000 | 11/1993 | LeBlanc, Jr. | 414/408 |
| 5,333,984 | 8/1994 | Bayne et al. . | |
| 5,447,405 | 9/1995 | Bayne et al. . | |
| 5,690,465 | 11/1997 | Ledwell | 414/408 |

*Primary Examiner*—James W. Keenan
*Attorney, Agent, or Firm*—Nikolai, Mersereau & Dietz, P.A.

[57] ABSTRACT

Loading mechanisms for front loading refuse trucks provided with fluid cylinder operated lift arms and associated fluid cylinder operated lift forks are provided with an improved operating system which allows the lift forks to attain one working position limit for tipping containers and an additional stowage position limit allowing the truck to travel with the arms fully raised.

2 Claims, 6 Drawing Sheets

LIFTING AND TIPPING MECHANISM FOR FRONT LOADING REFUSE TRUCK

BACKGROUND OF THE INVENTION

I. Field of the Invention

The present invention pertains generally to refuse collection vehicles and to associated material handling equipment including a vehicle body having a collection receiving receptacle and an integral container lifting and tipping mechanism for use during collection efforts. More particularly, the invention focuses on loading mechanisms for front loading refuse trucks and on an aspect related to the control and stowage for travel of the lift forks of a container lifting and tipping apparatus characterized by pivoting lift arms and connected lift forks.

II. Related Art

Front loading-type refuse handling equipment typically includes a pair of spaced lift arms connected to opposite sides of the vehicle body and a pair of extendable lift forks connected to pivot from joints at the ends of the lift arms and designed to engage corresponding fork receiving passages or recesses connected to the opposite sides of a refuse container for lifting and dumping the refuse container into a refuse charging hopper on the vehicle.

The arms and forks are designed to pivot in parallel planes in the direction of the vehicle length to address a container in front of the vehicle and lift it over the cab and empty the container into a charging hopper behind the cab. The forks are designed to be rotated forward as a container is lifted by a rearward pivoting action of the spaced arms to maintain the container in a generally upright position until it is over the charging hopper where the forks are rotated rearward to tip the container.

With regard to the design of the mechanism for lifting and tipping containers, when the system is in use, it is necessary to limit the rearward pivotal travel of the forks relative to the lift arms to prevent the container from contacting the ejector or other internal parts in the charging hopper which might cause the container to be lifted off the forks and allowed to fall into the hopper or otherwise damage either the container or the vehicle. When the front loader is traveling down the road, other factors come into play. It is clearly undesirable for the lift arms to be in their fully lowered position with the forks protruding horizontally, this extends the overall length of the vehicle and leaves the protruding forks in a position where they can easily cause damage to objects or be damaged themselves. On the other hand, if the arms are allowed to remain in the fully raised position, the forks protrude upward and the vehicle may exceed legal height limitations or the allowable useful storage height must be reduced accordingly.

It has, therefore, become customary to drive such front-loading vehicles with the arms and forks in a partially raised position to avoid these problems. This solution, however, also creates problems of its own. In the partially raised position, the forks are located at a height approximately equal to the top of the windshield on the truck cab which can distract the driver. It has also been found that this may produce undesirable sway during movement of the vehicle; and driving with the arms in the partially raised position transmits additional road shock and impact to the arm pivot bearings located on the body of the vehicle which produces rapid wear and early failure. It appears that travel with the fully raised arms potentially provides the fewest problems. Thus, it would be desirable if the vehicle could travel over the road with the arms in the fully raised position if the over height problem could be resolved.

One alternate solution to the situation is presented in U.S. Pat. No. 4,547,118 to Pittenger in which the pivotal fork arms are made foldable vertically relative to the lift arms when the latter are in a lowered or transport position to eliminate horizontal protrusion. That mechanism also includes a cam abutment arrangement to establish the minimum angle to which the fork arms can be moved relative to the lift arms in the container unloading position to prevent interference between the vehicle and the refuse container.

It would desirable, however, to provide a mechanically uncomplicated system that limits fork travel to permit safe tipping yet allows the forks to be fully retracted into the charging hopper when the arms are in the fully raised position for travel down the road. In this manner, there would be two required positions for the forks when the arms are fully raised; namely, one position for tipping a container into the receiving or charging hopper and one fully folded position for traveling which exceeds the tipping or working position. Attempts have been made to accomplish this, for example, by sensing the position of the forks with a proximity or mechanical switch which can be used to limit the travel depending on whether a working or traveling mode is desired. A system of this nature, unfortunately, involves wiring, wire routing, switches and the like which produce, in the end, a complex system which may fail and leave the loading mechanism totally inoperative.

There clearly remains a need to provide an uncomplicated method for controlling the position of the forks so that both a working position and a traveling position can be realized without additional moving parts or complicated electrical or electromechanical interlocks.

Accordingly, it is a primary object of the present invention to provide an improved control system for a lifting and tipping apparatus associated with a front loading refuse vehicle having pivoting lift arms and lift forks which improves the flexibility of operation of the lift forks.

A further object of the present invention is to provide an improved control system for operating the rotating lift forks associated with a front loading refuse vehicle which allows the forks to have one folded position for container tipping and one for stowage.

Another object of the present invention is to provide an improved control system for a lifting and tipping apparatus associated with a front loading refuse vehicle which allows stowage of the forks for travel with the lift arms in their fully elevated position.

A still further object of the present invention is to provide an improved control system for a lifting and tipping apparatus associated with a front loading refuse vehicle which allows multiple folding positions of the lift forks and yet does not interfere with the normal lifting and tipping cycle.

A yet still further object of the present invention is to provide an improved control system for a lifting and tipping apparatus associated with a front loading refuse vehicle which controls the rotation of the lift forks by controlling the operating speed of the lift fork cylinders.

Yet another object of the invention is to provide a flow-limiting, speed-modulating or cushioning system with respect to the operation of the lift fork cylinders of a lifting and tipping apparatus associated with a front loading refuse vehicle.

Other objects and advantages will occur to those skilled in the art upon familiarization with the specification and drawings contained herein.

SUMMARY OF THE INVENTION

In accordance with the present invention, previous problems associated with the ability of a lifting and tipping apparatus attached to a front loading refuse vehicle to assume a travel or stowed configuration with the arms in the fully raised position, yet be able to lift and tip a cart of interest without fear of damaging the truck body or cart, have been solved by the provision of an improved control system directed to the rotation of the lifting forks that enables one angular position to be assumed for working or container tipping and one for stowing or traveling. This is accomplished by providing a time delay in the form of a cylinder speed control for the cylinders for positioning the front loader forks which causes these fork cylinders to slow appreciably when they reach a position corresponding to the cart tip position of the forks, i.e., the position required to tip or dump the container. By slowing the piston speed severely at this juncture, the container can be dumped and the cylinders reversed to replace the empty container before the forks reach an angular position which could present a problem to the lifting and tipping operation, i.e., before the container can contact the vehicle body.

In the detailed embodiment, the cylinders associated with fork positional operation are provided with a flow restriction system which severely restricts the flow of hydraulic fluid from the port in the vicinity of the end of the cylinder and past which the piston is advancing as the fork rotates rearward. The piston operating within each fork operating cylinder is configured to retract as the forks pivot rearward and is provided with a flow limiting orifice which cooperates with an associated piston ring to limit outward fluid flow as the piston crosses the port closest to the retraction end of the cylinder as the cylinder continues to retract. At this point, the speed of the piston slows abruptly and dramatically as outward flow of fluid is greatly diminished. The piston ring is slidably fit in a relatively wide or over-wide groove in the piston and is free to move along the groove in accordance with the direction of fluid flow past the ring.

The provision of the over-wide groove containing the piston ring provides an additional seal as oil attempts to escape as the position of the ring against the upper side of the groove toward the port limits outflow to flow through the orifice provided in the piston. The orifice passage, of course, can be sized according to any desired design. However, when the operation of the double-acting cylinder is reversed and returned to the extending mode and the high pressure hydraulic fluid is caused to enter that same port, the piston ring moves in accordance with the fluid flow away from the port and thereby opens an additional flow area along the groove so that the cylinder may extend at a rate much faster than it retracts with the total cushioning effect. The additional fluid path allows a much quicker extension and return of the forks to the normal operating range. While the illustrative embodiment shows the cylinder cushioning system used in the end in which the piston is fully retracted, it will be appreciated that the cushioning system may be used in either end of any double-acting cylinder.

In an alternative embodiment, an auxiliary hydraulic manifold is provided that may be mounted on each fork cylinder and which includes a double pilot-operated, multi-position valve in the hydraulic fluid line connected to the blind end of the cylinder. The valve has a free-flow extend position, a free-flow retract position and restricted flow retract position. The valve switches to the restricted flow retract position when a pilot line is opened to high pressure supply fluid by the retraction of the piston to expose a pilot port in the cylinder. During extension, a second alternate pilot is pressurized to insure free-flow of fluid into the blind end of the cylinder. Flow restriction is obtained by requiring the return fluid to flow through a small orifice, or the like.

In operation, as a container is lifted, the operator watches the fork position, as with a convex mirror, or the like, located outside of the truck door. He can easily observe the position of the arms and forks. The arms normally rest on a rubber cushion or stop when in the fully raised position and the driver or operator will be able to recognize when the fork cylinder position reaches the slowed or restricted speed mode as the hydraulic pressure will immediately increase to reach the main relief valve pressure setting, and the truck engine will begin to labor. The cylinder movement will also be observed to decrease from a normal speed to a mere "creep" speed. The container will empty immediately and can be "rocked" or simply replaced to the ground position by reversing the operation. If it is desired to stow the forks for travel, there will be no container on the forks and the cylinders can simply be allowed to continue to retract until they "bottom out" at the slow speed.

BRIEF DESCRIPTION OF THE DRAWINGS

In the drawings, wherein like numerals are utilized to designate like parts throughout the same.

DETAILED DESCRIPTION

Figure 1:
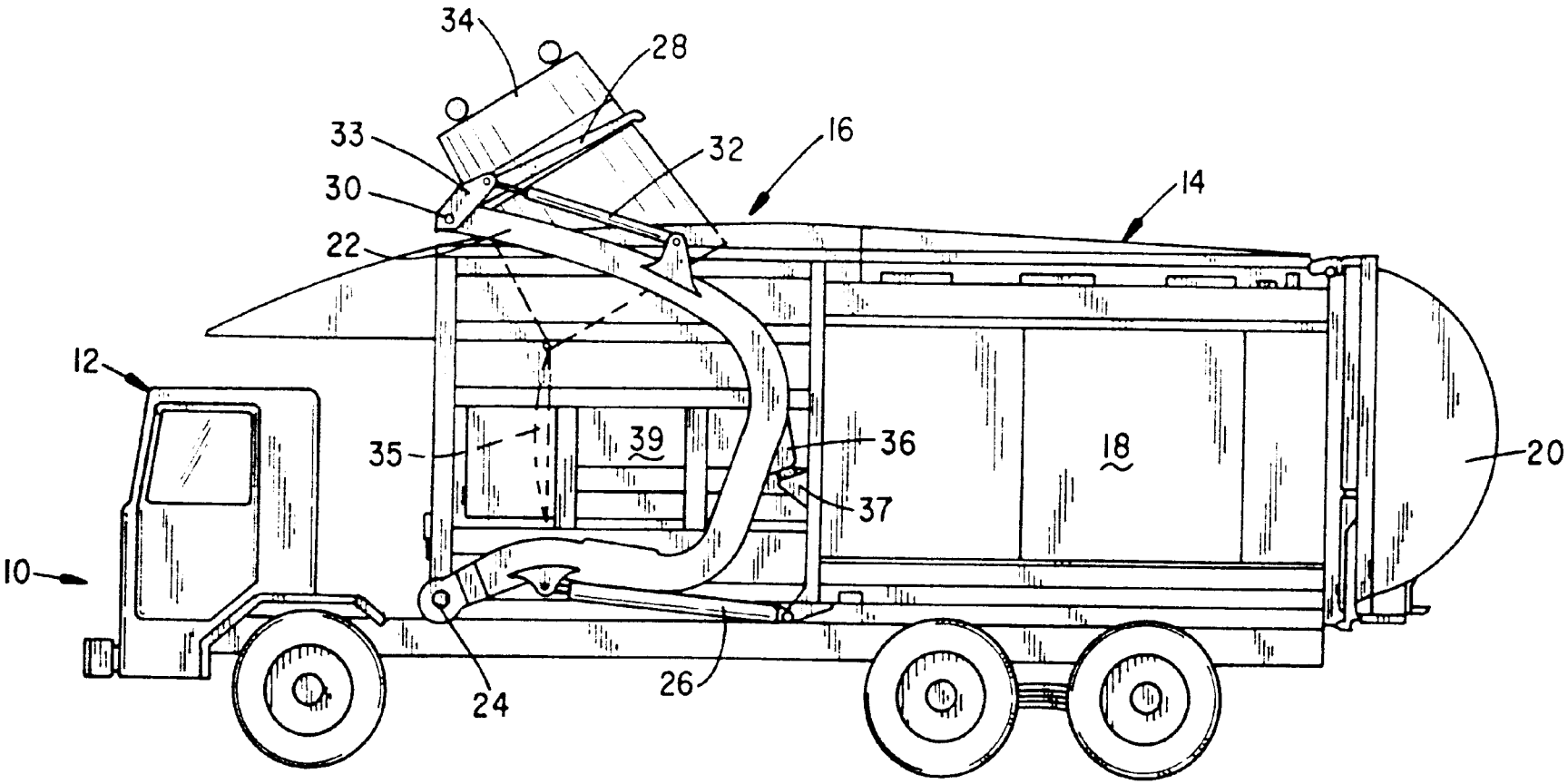
FIG. 1 depicts a side elevational view of a front loading refuse vehicle illustrating the lift arms fully raised and the forks in the container-tipping position and including a container being tipped.
Figure 2:
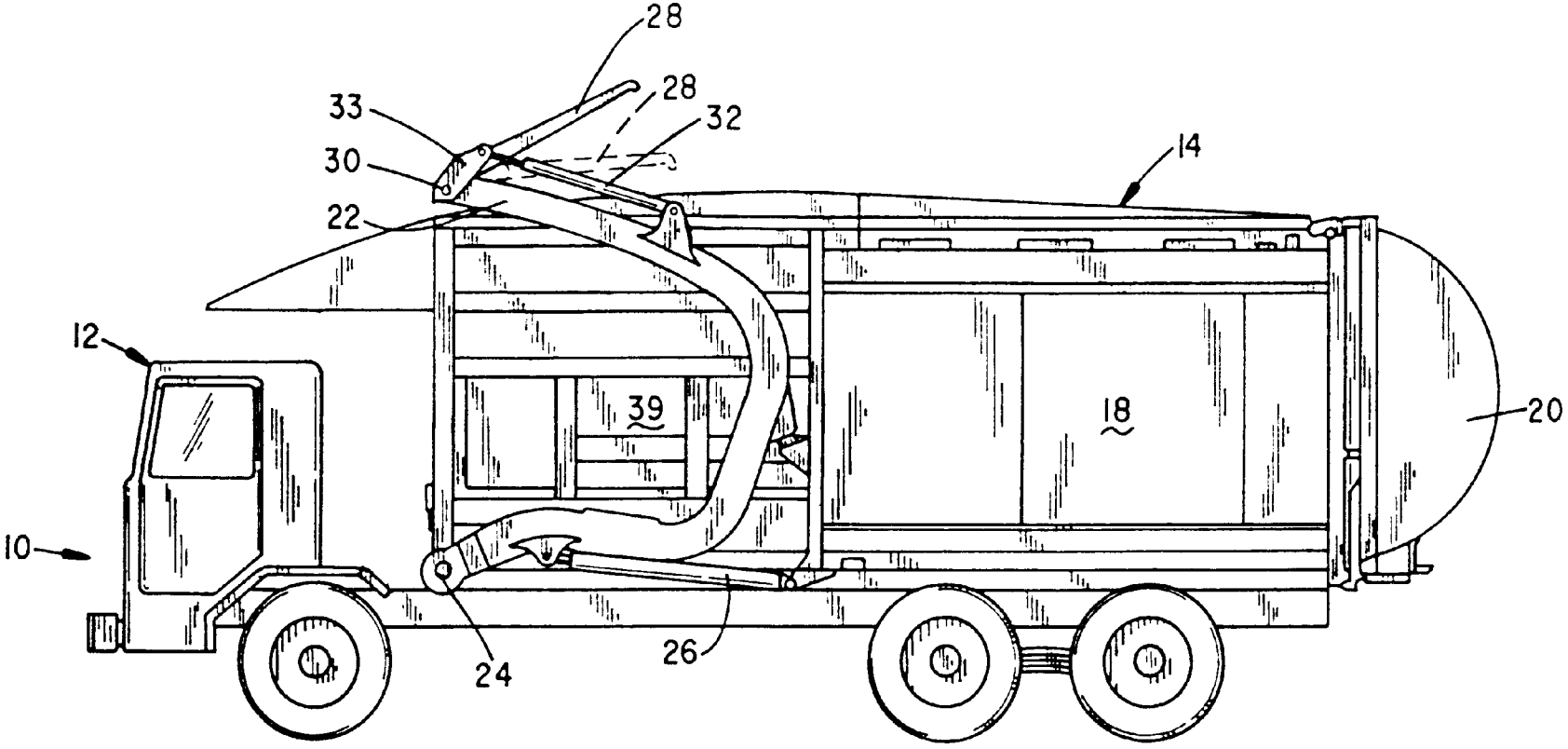
FIG. 2 is a view similar to that of FIG. 1 illustrating the lift forks alternatively in both the tipping and stowed or travel positions.

One embodiment illustrating the invention is shown in FIGS. 1–5. Although FIGS. 1 and 2 show only one side of a front loading refuse truck of the indicated class including only one side of the front end loading mechanism, it will be appreciated, and is well known, that corresponding symmetrical and cooperative parts are located on the opposite side of the vehicle. The apparatus of the present invention generally includes a front loading lift and tip or dump mechanism commonly associated with front loading refuse vehicles. Of course, the vehicle may contain one large or a variety of smaller compartments designated to segregate a plurality of types of waste as is the case with recycling vehicles or the like. The front loading lifting and tipping apparatus associated with the vehicle is typically hydraulically operated and powered by the principal hydraulic system of the vehicle which includes a hydraulic pump to supply high pressure fluids, together with the necessary cylinders, control valves and actuators. It is noteworthy that the improved lifting and tipping mechanism of the invention does not require additional cylinders or electric or hydraulic control mechanisms and the cushioned or flow-limited cylinders of the invention can be retrofitted easily into existing systems. The cylinders operating the forks are double-acting cylinders.

FIG. 1 depicts a side view including a truck chassis which includes a cab 12 which houses the controls for the vehicle and the operator. A refuse collecting body 14 is supported on the chassis 10 and includes a refuse receiving or charging hopper section 16 having an opening for receiving refuse dumped into the charging hopper. A refuse storage volume is shown at 18, together with a tailgate 20 utilized for discharging the material. The vehicle includes a front end loading mechanism having a pair of lift arms, one of which is shown at 22 and which are pivotally mounted to the vehicle on heavy bearings as at 24. A pair of heavy fluid cylinders as at 26 are utilized to operate the arms pivotally about the pivot points 24. The arm illustrated in FIG. 1 is in the fully raised position. A pair of forks as at 28 are pivotally attached to rotate at the ends of the lift arms 22 as at bearing pivot joint 30. The forks are pivotally operated about their connecting pivot joints as at 30 utilizing double-acting cylinders as at 32 with connected lever arms as at 33. A collection container 34 is illustrated in the fully tipped or inverted position, with its open top 35 shown well inside the charging hopper volume 39 of the truck body 14. Arm rests are provided for the fully raised arms in the form of brackets as at 36 and 37 attached respectively to the arms and truck body and a cushioning rubber bumper attached to the truck body bracket. Note that the illustrated fork 28 is disposed in position to fully tip the container 36 yet extends upward well above the end of the raised arm 22.

FIG. 2 illustrates a view similar to that depicted in FIG. 1 without the tipped container and depicts the alternate position for one fork 28. In addition to the tipping or working position shown in phantom, previously illustrated, in which it is raised to extend well above the top of the vehicle, it is shown in the stowed or travel position (solid line) in which is has rotated an additional amount and no longer protrudes above the end of the lift arms 22.

Figure 3:
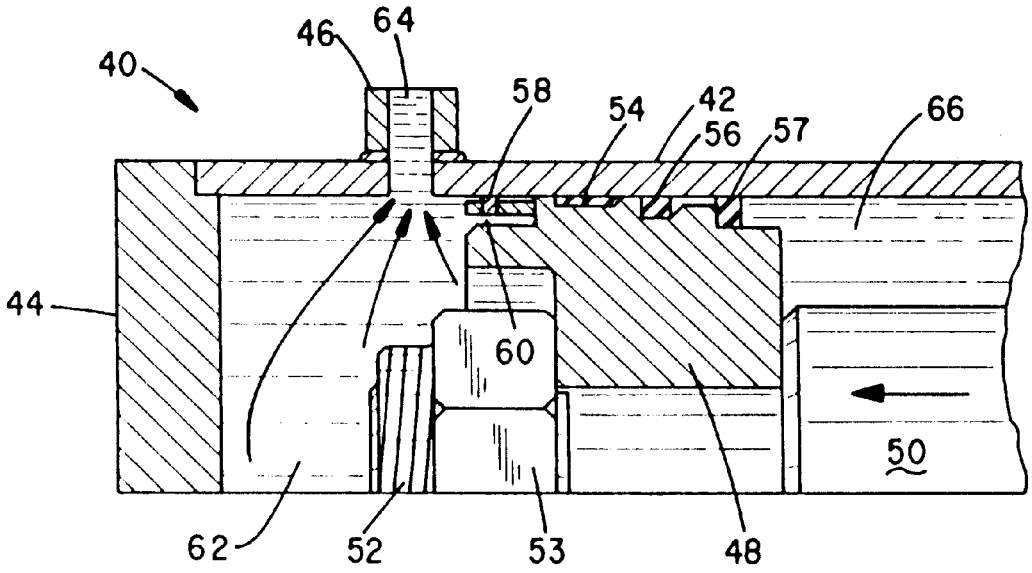
FIGS. 3–5 are similar fragmentary views partially in section of a part of a fluid cylinder illustrating one flow restriction or cushioning system in accordance with the invention.
Figure 4:
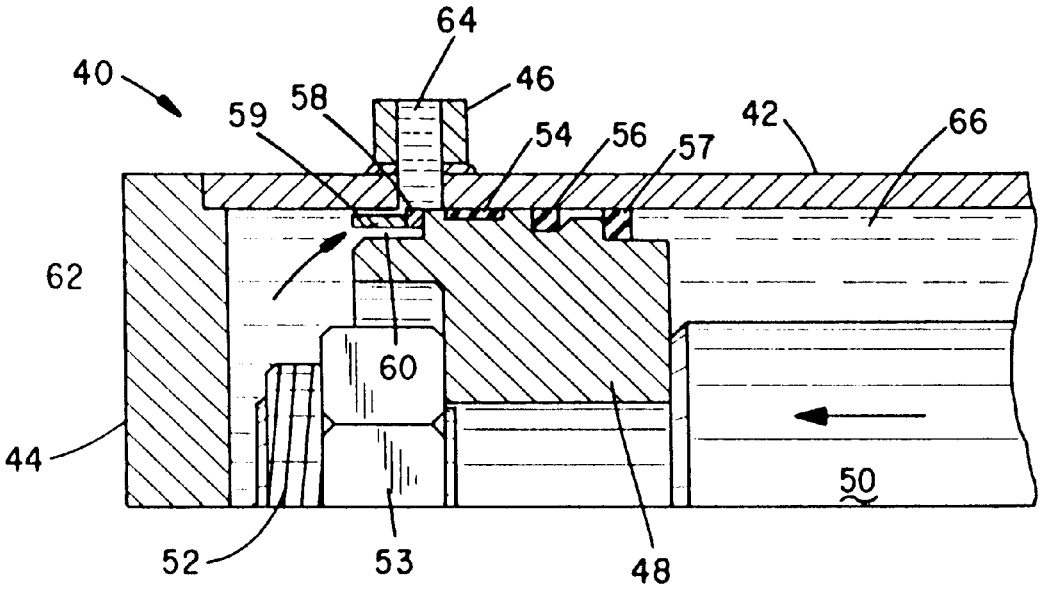
Figure 5:
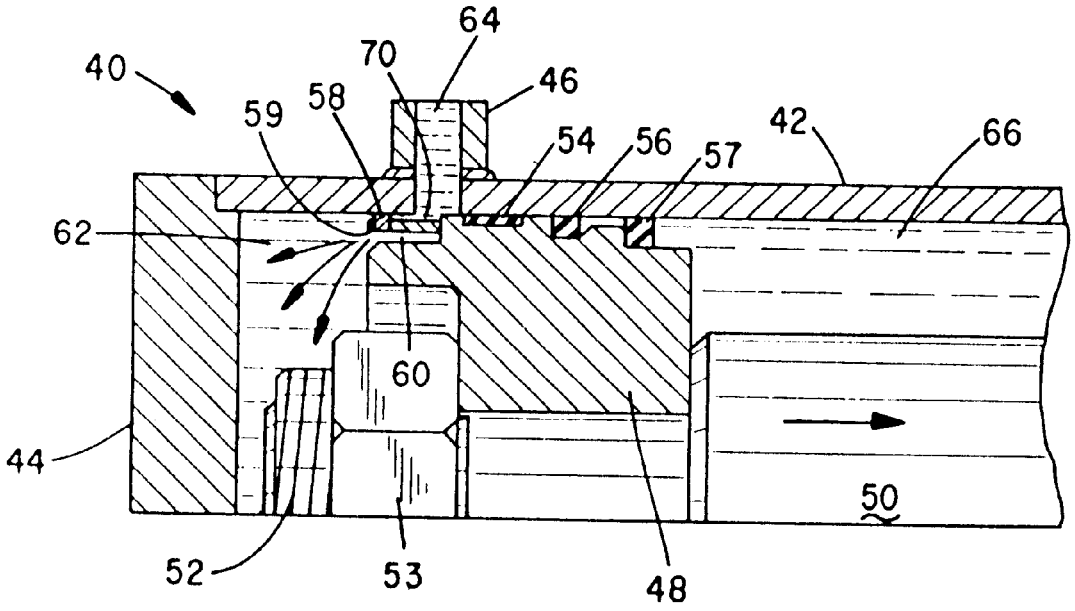

FIGS. 3–5 illustrate fragmentary portions of a cylinder which may be one of the cylinders 32 of FIGS. 1 and 2 connected to actuate the pivoting of the forks 28. The partial cylinder at 40 includes a cylinder sidewall 42, end plate 44 and a fluid port is illustrated at 46. A piston is illustrated partially in section at 48 and the connected piston rod at 50. The threaded end of the piston rod 50 is shown at 52 with a piston retaining nut 53. Conventional moving piston fluid seals are shown at 54, 56 and 57.

In accordance with the invention, a very wide groove 59 is provided in the piston, typically by machining, and a piston ring 58 is mounted in the groove providing an additional moving seal with the sidewall 42 but also having some axial travel latitude along and within the groove. The piston is further provided with a metering orifice or channel at 60 which connects the retraction end fluid pool 62 with the opening 64 in the cylinder port 46 when the port is blocked otherwise by the piston. FIG. 3 illustrates the system with the piston and rod traveling in the direction indicated such that the pool 62 is being exhausted through the port 64 by the pressure exerted by the high pressure fluid behind the piston at 66. Note that the port opening 64 is fully exposed to the fluid pool 62 so that the flow of fluid through the port is not in any way impaired. In this condition, the piston and cylinder operate at normal speed.

FIG. 4 illustrates the same fragmentary cylinder view as in FIG. 3 with the piston 48 shown just crossing the port as the cylinder is retracting. The point that the cylinder piston 48 crosses the port opening 64 is designed to correspond to the point at which the fork controlled by the cylinder reaches the designated work position as illustrated in FIG. 1. As can be seen from the drawing, forcing the cylinder to continue to move to the left meets with additional resistance as the hydraulic fluid outflow through the port 46 is severely restricted such that all the fluid must now leave the cylinder through the small orifice 60 in the piston 48. In this part of the cycle, the oil flow from the cylinder end at 62 causes the piston ring 58 to be forced against the right side of the oversized piston ring groove 59 such that the oil cannot flow outward except through the orifice 60. This situation continues until the piston bottoms out in the cylinder and, at this point, the fork has reached its extreme position approximately as shown in the lowered position in FIG. 2.

FIG. 5 illustrates the cylinder fragment of FIGS. 3 and 4 at the point where the double-acting cylinder is reversed such that the port 46 has become the high pressure or inlet port and the pool 66 is being exhausted through a rod end port at the other end of the cylinder (not shown) as the cylinder moves to the right and the corresponding fork is rotated toward the front of the truck. This, of course, is the cylinder extend mode in which oil flows into the rear port to extend the cylinder. It should be noted that the piston ring 58 now moves to the opposite end of its groove 59 thereby providing an additional oil path extending circumferentially about the piston at 70 enabling the oil to flow more quickly into the cylinder and thereby allow the cylinder to extend at a speed which is at or close to normal speed.

Figure 6:
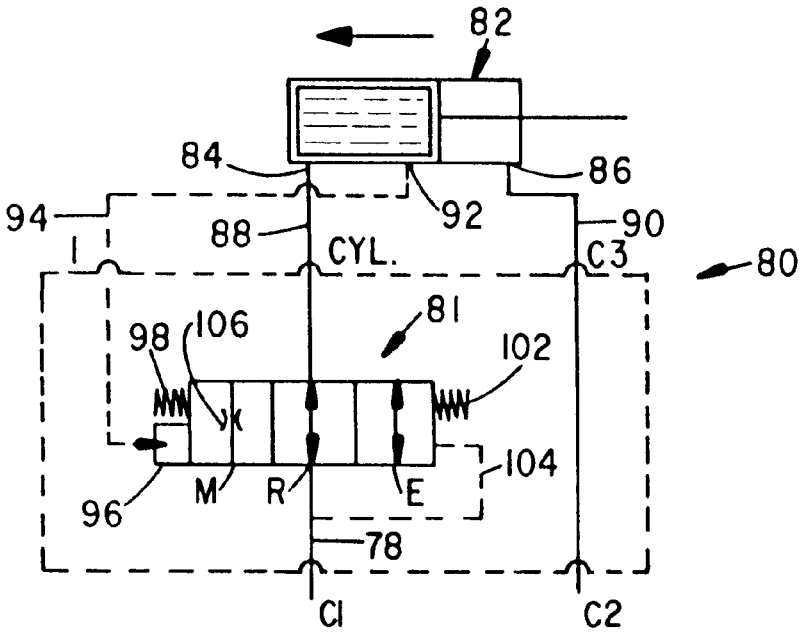
FIGS. 6–8 are schematic views of a cylinder and attached hydraulic manifold system showing the operation of an alternative embodiment of the flow restriction system of the invention.
Figure 7:
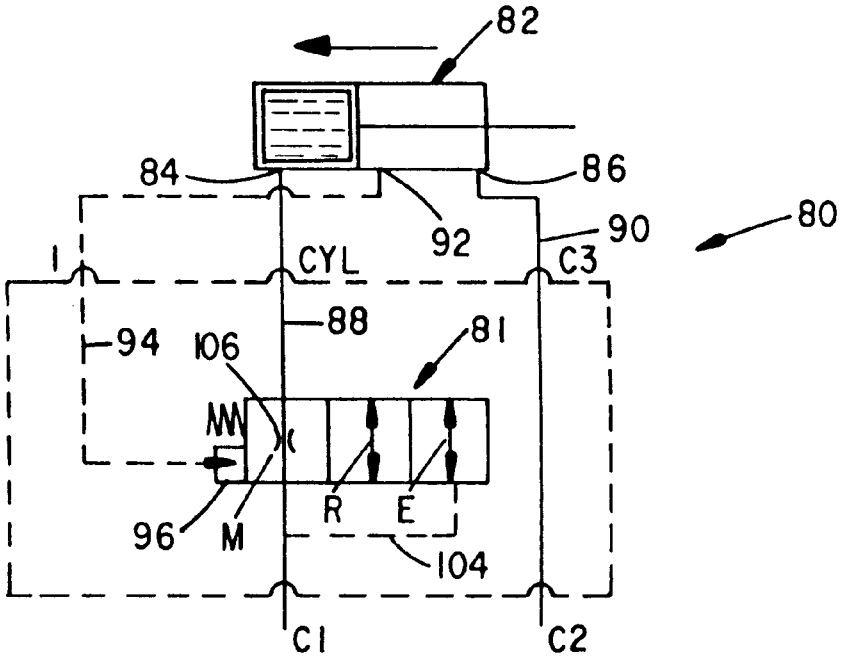
Figure 8:
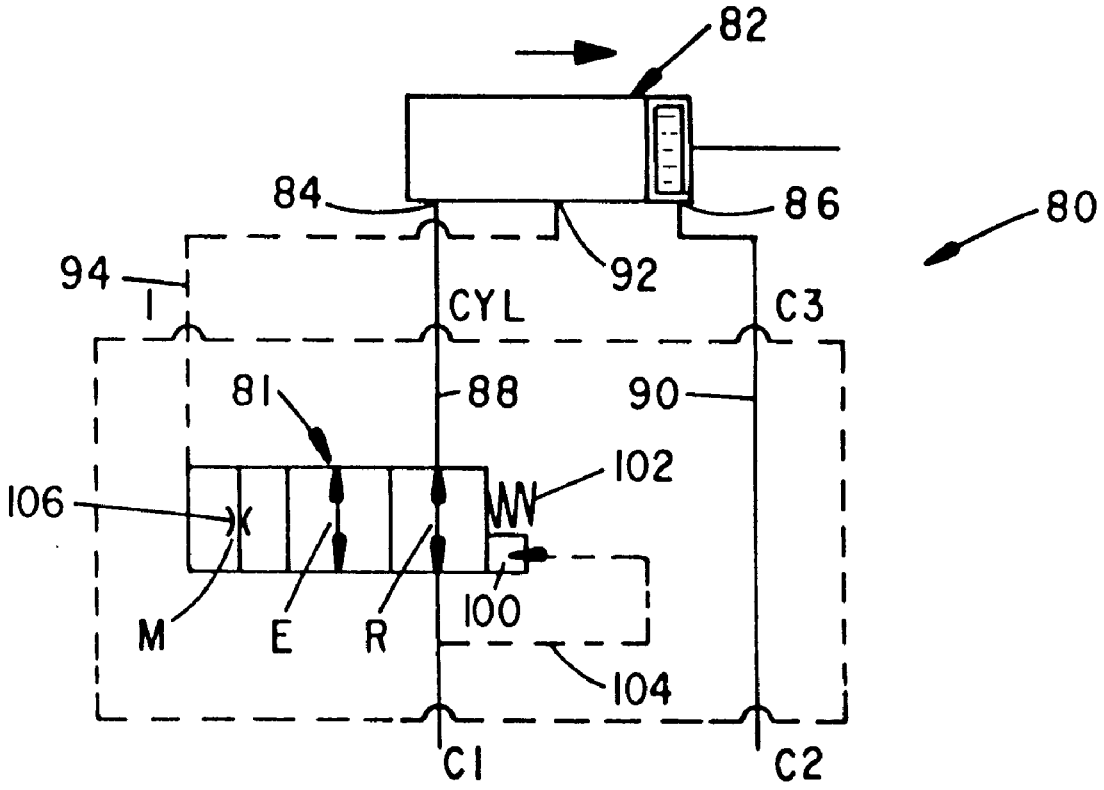

Finally, FIGS. 6–8 illustrate an alternative embodiment in which a hydraulic manifold, generally at 80, which also includes a 3-position, 2-pilot cartridge or valve assembly 81, is shown attached to a cylinder 82 which also may be similar to one of the cylinders 32, FIG. 1, operating the forks of a front loading refuse truck. The cylinder 82 has a blind or barrel end port 84 and a rod end port 86 respectively connected to line 88 and 90. A pilot port 92 is situated at a point along the cylinder 82 where cushioning is desired and is connected to a pilot line 94 which is, in turn, connected to a retract pilot valve operator port 96 spring-biased at 98. The cartridge or valve 81 has a second pilot port 100 spring-biased at 102 and connected to blind or barrel end fluid line 88 by pilot line 104. An orifice meter is provided at 106. The positions of the 3-position and cartridge or valve assembly include an extend position E, a retract position R and a retract metered position M.

The operation of this system is readily discerned from the consecutive figures which start with FIG. 6 in which (in the direction of the arrow) the retraction of the cylinder 82 has begun and hydraulic fluid is flowing into the rod end of the cylinder through line 90. The cylinder is retracting at a normal speed with the return fluid draining through R in an uninhibited fashion. In this position, the pilot lines 94 and 104 and the pilot valves 96 and 100 are both exposed only to the pressure in the unrestricted drain line 88 and the valve will not switch. In FIG. 7, the piston of the cylinder has progressed beyond the pilot port 92 so that pilot line 94 and pilot port 96 are exposed to the high pressure incoming hydraulic fluid. This causes the valve or cartridge 81 to shift into the metering position where the return fluid is subjected to metering through the orifice at 106. FIG. 8 depicts the cylinder operating in the extend mode in which the fluid is supplied through line 88 to the barrel or blind end of the cylinder 82 through the E ports of the 3-positioned valve or cartridge 81 which has been switched by the pilot valve 100 which is exposed to the full incoming pressure through line 104 to overcome the spring 102. In this mode, the pilot port 92 will not see any more pressure than the port 100 so that the cartridge or valve 81 will remain in the extend position. In this mode, return fluid flows out of the rod end unrestricted through line 90.

In operation, as previously indicated, the operator can easily watch the fork position using a convex mirror located on the outside of the truck door (not shown), for example, and can readily observe the positions of the arms and forks. The driver will be able to recognize the fork cylinder position when it reaches the severe cushion mode as the hydraulic pressure will immediately reach the peak or relief valve pressure and the engine will begin to labor thereby indicating to the driver that the full working position has been reached. In addition, when the cylinder reaches this point, its movement will slow to a very slow speed. This gives the driver ample time to allow the material to fall from the container being emptied. The container can also be rocked at this point if desired. Thereafter, he can reverse the cylinder prior to its bottoming out and causing possible damage to the truck. When it is desired for the forks to be carried in their fully folded position, the operator simply allows the cylinder to continue operation until the piston bottoms out.

Of course, the illustrated embodiment shows the forks being pivoted rearward with the cylinders in the extend mode, but those skilled in the art will readily recognize that the piston works equally well when the system is configured for the double-acting cylinder to operate in the opposite mode.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A front end loading mechanism for a load receiving and hauling motor vehicle comprising:

(a) a pair of lift arms pivotally mounted on the vehicle;

(b) means for actuating said lift arms through an arc including a lowered container receiving and releasing position, and a fully raised container emptying position;

(c) a pair of spaced lift forks mounted to pivot relative to said Lift arms;

(d) a fork positioning system for determining and controlling the angular position of said lift forks relative to said lift arms including means for operating said forks at a first speed from a relatively horizontal container engaging, releasing position through a lift segment in which the forks are rotated forward, to maintain a container in a generally upright position as the lift arms are raised, and reversing the pivot direction of said lift forks to a tip point sufficient to empty the container into said vehicle;

(e) a direction-biased speed reducing system enabling said lift forks to selectively rotate beyond said tip point to a storage point at a second speed less than said first speed and return to a forward position at a speed higher than said second speed;

(f) wherein said fork positioning system includes a pair of double-acting fluid operated fork cylinders each having a reciprocating piston and being connected to fluid supply and drain lines and connected to pivot said lift forks, said cylinders including speed control means including a direction-biased internal fluid flow control device to slow the pistons appreciably from said first speed to said second speed when the fork cylinders are rotating said lift forks toward said storage point and said lift forks reach the tip point position;

(g) wherein each said fluid operated fork cylinder includes a follower rod connected to said piston and wherein said cylinder is provided with a fluid ingress and egress access port, said piston reaching said access port at a point corresponding to said tip point of a container and wherein said flow control device includes limited flow path means including an orifice channel in said piston through which said fluid must travel to egress when said piston reaches said access port; and (h) wherein each said piston is further provided with a circumferential groove and a piston ring in said groove, said piston ring providing a seal between said piston and said cylinder and wherein said groove is wider than the thickness of said ring and so said ring is free to move a distance along said piston in said groove in a manner such that the piston ring provides a seal limiting egress of fluid to said orifice channel while providing an additional fluid path for fluid ingress.

2. The mechanism of claim 1 wherein said fork cylinders are hydraulic cylinders.

* * * * *